United States Patent [19]

Ponzellini

[11] 4,411,471

[45] Oct. 25, 1983

[54] ARM SUPPORT MEMBER FOR SEATS OR CHAIRS, HAVING A VERTICALLY LIFTABLE ARM REST

[75] Inventor: Giulio Ponzellini, Bologna, Italy

[73] Assignee: Castelli S.p.A., Bologna, Italy

[21] Appl. No.: 233,886

[22] Filed: Feb. 12, 1981

[30] Foreign Application Priority Data

Feb. 15, 1980 [IT] Italy ..... 35569/80[U]

[51] Int. Cl.[3] ..... A47C 7/54; B60N 1/06

[52] U.S. Cl. ..... 297/417; 297/239

[58] Field of Search ..... 297/417, 239, 411, 412, 297/422, 248

[56] References Cited

U.S. PATENT DOCUMENTS

| | | | |
|---|---|---|---|
| Re. 25,985 | 3/1966 | Klassen | 297/239 |
| 3,269,772 | 8/1966 | Brunskole | 297/417 X |

FOREIGN PATENT DOCUMENTS

| | | | |
|---|---|---|---|
| 651193 | 10/1937 | Fed. Rep. of Germany | 297/239 |
| 2315241 | 1/1977 | France | 297/417 |
| 89997 | 8/1937 | Sweden | 297/239 |

*Primary Examiner*—James T. McCall

*Attorney, Agent, or Firm*—Murray Schaffer

[57] ABSTRACT

An arm support member for chairs or seats provided with an arm rest frame connected to said arm support member by a hinge mechanism. The arm rest frame is swung under the effect of a first spring into a vertical position, by a rotation about a horizontal axis parallel to and spaced apart from the longitudinal center plane (A-A) of the arm support member. The hinge mechanism also enables the arm rest frame to perform a sliding movement parallely to the hinge axis against the effect of a second spring only when the frame is in its raised position. Locking means is provided to hold the arm rest in both positions.

8 Claims, 6 Drawing Figures

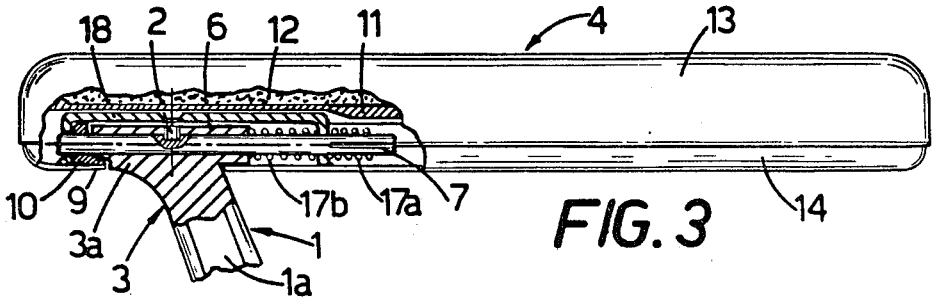
FIG. 3
FIG. 4
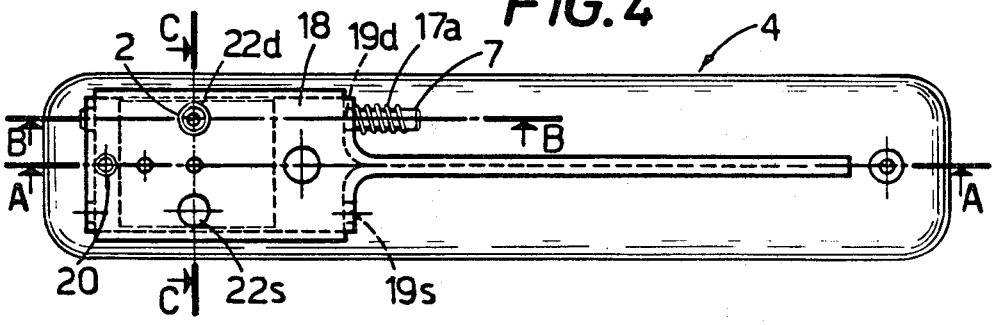
FIG. 5
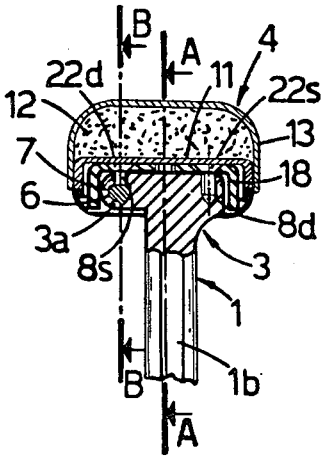
FIG. 6
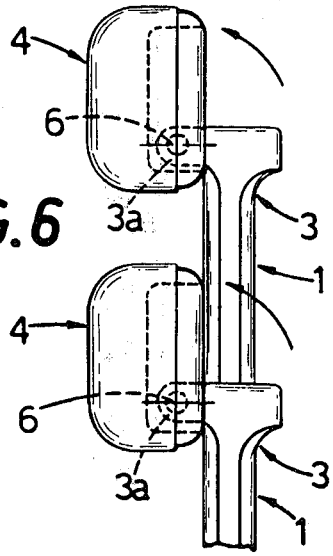

ARM SUPPORT MEMBER FOR SEATS OR CHAIRS, HAVING A VERTICALLY LIFTABLE ARM REST

The present invention relates to arm support members for seats or chairs which consists of a V-shaped body carrying an arm rest, which may be covered or not by upholstery and which is mounted on said support member in cantilever relationship and which is pivotally connected thereto so that said arm rest can be swung from its horizontal use position into a vertical position for the piling up of a columm of chairs or seats, by means of a pivotal movement through an angle of 90° about a hinge axis positioned near the outer longitudinal side of said arm support member of a chair or seat so as to readily permit stacking of one chair or seat on another in a mutual partial interpenatrating relationship, so as to reduce the space occupied by the plurality of piled up chairs or seats.

The hinge mechanism provided between the arm rest and the arm support member carrying the arm rest is also so designed as to permit the arm rest to be mounted either on a right-hand or left-hand arm support member of a chair or seat. Additionally, each arm rest is so constructed as to permit it to be permanently fixed to the arm support member in the event that the user has no interest in stacking the chair on another.

Arm support members for chairs or seats are already known, made of a metal structure and which are each connected to a small frame designed to form an arm rest, of a vertically liftable type, for the user's arm. But the known arm support members must be differently constructed in order to serve for left-hand or right-hand arm support members.

In addition each of the known arm support members includes a upper plate for carrying the arm rest frame; from said plate some teeth project upwardly which serve as locking means to lock the arm rest frame to said plate, and therefore, to the arm support member, when the arm rest frame is in its horizontal use position. Therefore, when said arm rest frame has been swung in its vertical position, said teeth, which extend upwardly from said plate, constitute dangerous gripping elements which adversely affects the stacking operation or the storing operation.

According to the present invention each arm support member consists of a V-shaped bar including a front inclined section which at its upper end is made integral with a short longitudinal bracket provided with a plurality of vertical threaded holes as well as with two parallel longitudinal holes, symmetrically positioned with respect to the vertical center plane of the bracket so that a hinge rod can be mounted either in the one or in the other of the two longitudinal holes. As a result thereof, each rest arm frame can be mounted either on the left-hand or the right-hand arm support member of the same chair or seat. Additionally, a locking device is provided which acts between the arm rest frame and the respective support member carrying said frame.

Said locking device consists of a innerwardly projecting longitudinal tooth carried by the arm rest frame and which can be engaged into a shaped locking seat arranged at the front portion of the bracket after an outwardly sliding movement of said frame with respect to the arm support member has been performed; said coupling becomes operative by the presence of a return spring.

These and other objects and advantages of this invention will appear more clearly from the following specification of an embodiment of his invention, in connection with the accompanying drawings, in which:

FIG. 3 is a longitudinal side view of the arm support member of FIG. 1, partially sectioned along a plane B—B of FIGS. 4 and 5 parallel to the plane A—A and containing the axis of the hinge rod of the arm rest frame;

FIG. 4 is a top view of the core body incorporated into the arm rest frame, assuming that the padding and cover means have been removed;

FIG. 5 shows the detail of the cross section C—C of FIG. 4 of the arm support member carrying the arm rest frame in the use position thereof; and FIG. 6 shows a front view of the upper portions of the right-hand arm support members of two piled up chairs, with their arm rest frames in their vertical position.

Figure 1:
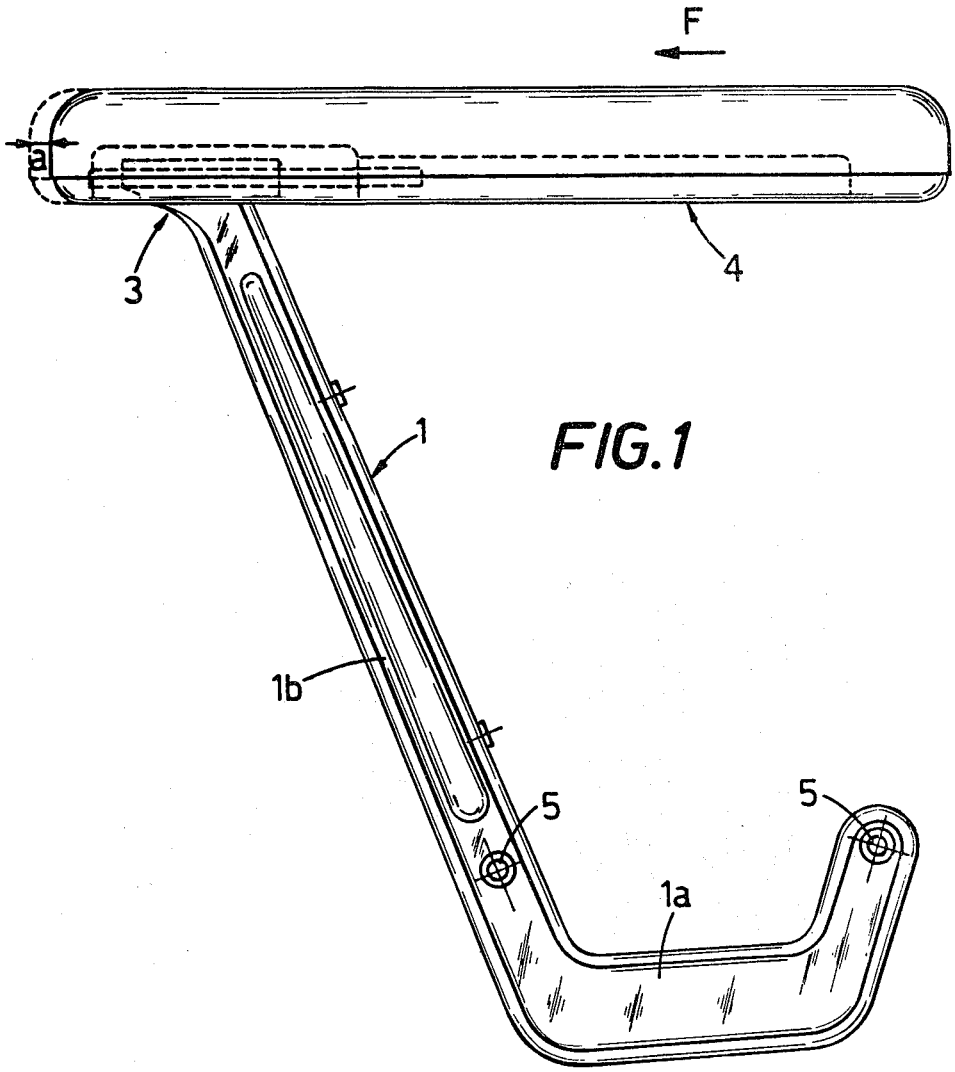
FIG. 1 is a side view of the arm support member, when removed from a chair and which is shown in the use position.
Figure 2:
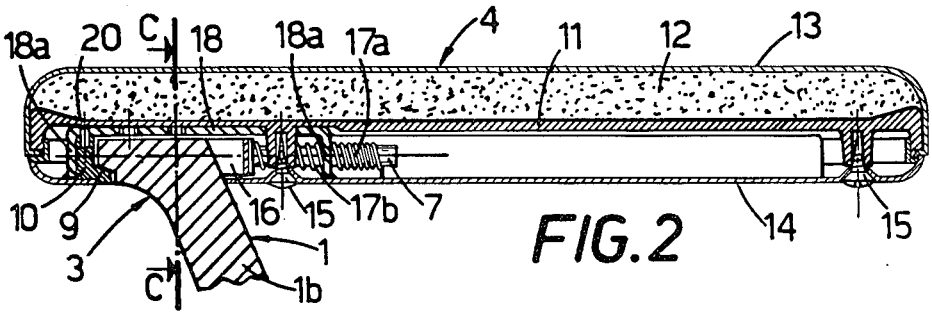
FIG. 2 is a partial longitudinal vertical section taken on the vertical center plane A—A of the arm support member of FIGS. 4 and 5.

Referring to the drawings in detail, at 1 is generally indicated the body of an arm support member which, according to a well known solution, comprises a short horizontal bar 1*a* made integral with a front bar 1*b* bent frontwardly and which at its top is in turn made integral with a short backwardly extending bracket 3, on which will be cantilever mounted a small frame 4 which may be covered by any suitable padding material or which may carry also a rigid cover element so as to form an arm rest. Said frame 4 extends backwardly from said bracket 3 towards the back rest of the seat or chair (not show in the drawings), to which each arm support member 1, 3 together with the respective arm rest frame 4 can be secured by means of screws inserted through the threaded holes 5 (FIG. 1) or by other suitable means so as to obtain a disassemblable or permanent connection between each arm support member 1 and the carrying structure of the respective chair or seat which has not be shown since it does not interest this invention. Each frame 4, as well as the body of each arm support member 1, 3 is made of metal or other suitable material. The bracket 3 has a length shorter than that of the frame 4 which is designed to constitute the arm rest for the user's arm.

The brackets 3 of the left-hand arm support members are in plan symmetrically identical to those of the right-hand arm support members; while, on the contrary, each frame 4, according to the present invention, can be mounted either on a bracket 3 of a left-hand or of a right-hand support member 1. The bracket 3 of each arm support member 1 extends outwardly beyond the outline of the respective member 1 so as to form a projecting portion 3*a* through which a longitudinal hole 6 is arranged designed to receive the hinge rod 7 of the hinge mechanism which connects the bracket 3 to the frame 4.

In the transverse cross plan C-C according to FIGS. 4 and 5 there are also provided through the bracket 3 two threaded holes 8*s* and 8*d* at the front a lower shaped portion of the bracket 3 recess is formed having a backwardly sloping surface 9. A locking tooth 10, having a cross section which is complementary to that of the recess 9 is fixedly located in the frame 4. This locking device 9, 10 co-operates with the hinge mechanism to pivotally connect the arm support member 1, 3 to the arm rest frame 4 and which will be further described in detail hereinafter. The frame 4 includes a core body 11 made of metal or other suitable strong material and which in plan has substantially such a shape so as to be able to accommodate therein the bracket 3 of the respective arm support member 1. The core body 11 is covered by a soft or rigid material 12 which will be in turn covered by an outer flexible covering 13, when a padded arm rest is provided. The core body 11 has its peripheral edges bent downwardly so as to define a recess for housing the hinge mechanism, said space being then partially closed by a thin removable shaped body 14 secured to the core body 11 by screws 15.

At the front portion the plate 14 has a rectangular opening 16 having a width slightly greater that of the bracket 3 so as to allow said bracket 3 to enter through the opening 16, as the frame 4 rotates about the hinge rod 7 to attain its horizontal position. The opening 16 is longer than the length of the bracket 3, by a value "a" sufficient in one instance to allow the tooth 10 to be slide frontwardly relative to the bracket 3 to obtain a disengagement of said tooth 10 from the recess 9, and in another instance to bring the tooth 10 ahead of the recess 9, so that the tooth 10 can be then engaged into the recess 9 under the effect of helical springs 17*a*, 17*b*. Springs 17*a* and 17*b* are mounted about the hinge rod 7, which is supported by a plate 18 having a longitudinal section in the form of an inverted U and which is fixed on the inner surface of the plate 14 by welding or other suitable system. The hinge rod 7 passes through the two transverse parallel flanges 18*a* of the plate 18, which are provided with two pairs of aligned holes 19*d* and 19*s*, designed to come into register with the hole 6 of a right-hand or a left-hand arm support member 1, 3. In contact with the inner surface of the front flange 18*a* of the U-shaped plate 18 is the locking tooth which is made of nylon or the like and which is fixed by screw 20 to the plate 18.

In the accompanying drawings a frame 4 is shown the parts on which are so mounted that it can be mounted of a right-hand arm support member 1. For such a purpose the rod 7 is mounted through the pair of holes 19*d* of the plate 18 (FIG. 4). On the contrary, when the frame 4 has to be mounted on a left-hand arm support member 1, the pivot rod 7 will be mounted through the pair of holes 19*s*. About the pivot rod 7 and at the portion thereof which is positioned out of the plate 18 a return torsion spring 17*a* is mounted designed to swing the frame 4 upwardly into its vertical raised position, while the spring 17*b* wound about the pivot rod 7 between the rear flange 18*a* of the plate 18 and the body of the bracket 3 is designed to return the frame 4 axially towards the body of the chair or seat, in the locking position, i.e. when the tooth 10 abuts against its engaging seat 9 in the use position of the assembly of the arm supporting member 1 and arm rest frame 4 (FIGS. 1 to 4).

When the chairs or seats have to be stacked one on the other, according to a partially mutual interpenetration thereof (FIG. 6), each frame 4 will be gripped and forced to longitudinally slide along the pivot rod 7. The pivot rod is made integral with the bracket 3 by means of a threaded dowel 2 which can be inserted through the hole 22*d* or 22*s* respectively of the plate 18 and which will be screwed into the threaded hole 8*d* or 8*s* respectively of the bracket 3 (FIGS. 4 and 5). The dowel 2 locks itself to the body of the rod 7. According to this arrangement the frame 4 not only can freely be rotated about the axis of the pivot rod 7, but it can also perform a longitudinal sliding movement towards the outside by a distance "a" in the direction of the arrow F of FIG. 1 up. Thus, the disengagement of the tooth 10 from its locking seat 9; is obtained. Afterwards the spring 17*a* causes the automatic upwardly swinging movement of the frame 4 placing the arm rest in vertical position and permitting the chairs or seats can be superposed according to a very compact disposition. In the event that the frame 4 has to be applied on a left-hand arm supporting member 1, the rod 7 and the springs 17*a* and 17*b* are mounted on the left-hand side of the frame 4 and the pivot rod 7 will be inserted in the pair of holes 19*s*.

If a raising of the arm rest frames 4 is not required, the holes 22*d* or 22*s* can be used to receive (not shown) screws for locking each frame 4 to the respective bracket 3 so as to obtain, instead of an arm supporting member 1 having a liftable arm rest frame 4, an arm supporting member 1 provided with fixed arm rest frame 4. Of course, in the bracket 3 provision will be made of locking holes 8*d* 8*s* for said locking screws.

I claim:

1. A stack chair comprising a main chair structure and at least one arm assembly, said arm assembly comprising a supporting bracket secured to said main chair structure and having a free end, a generally rectangular arm rest frame and a hinge mechanism for pivotably securing said arm rest frame to the free end of said bracket, said hinge mechanism having a hinge axis parallel to and offset from the vertical center plane of said arm rest member to allow said frame to be moved from a substantially horizontal use position to a vertical stack position, said hinge mechanism having locking means provided to lock said bracket and frame in both the aforementioned use and stack positions, first spring means provided to urge said locking means in its engagement position, and second spring for causing the frame to be automatically swung to its vertical position, on moving said arm rest against the bias of said first spring means.

2. The stack chair according to claim 1 wherein said free end of said bracket is provided with through bores and said arm rest frame includes a plate depending from its lower surface having an inverted U-shape defining between its flange arms a space sufficient to receive the free end of said bracket and permit longitudinal shifting of said arm rest frame by a predetermined distance each of said flange arms having a hole therein, and said hinge mechanisms including a rod extending freely through the hole in said flange arms and through said bore to connect said arm rest to said bracket and permit movement of said arm rest longitudinally and to swing rotatively about the axis of the rod.

3. The stack chair according to claim 2, wherein said first spring means comprise a helical spring located about said rod interiorly of one flange arm of said U-shaped plate and said bracket, and said second spring means comprises a torsion spring located about said rod, exteriorly of said one flanged arm of said U-shaped plate, and said locking means is located on the other end of said bracket and said other flange arm of said U-shaped member.

4. The stack chair according to claim 3 wherein said locking means comprises a tooth member formed on said bracket and a recess formed on said U-shaped plate, said tooth and recess being engageable on longitudinal movement of said arm rest.

5. The stack chair according to claim 4 wherein said tooth a recess is formed of nylon.

6. The stacked chair according to claim 2 wherein the free end of said bracket includes a pair of through bores, respectively offset from the vertical central axis, and the flange arms of said U-shaped plate are each provided with a pair of vertically aligned holes respectively offset from the vertical central axis, said rod, bracket and arm rest being adapted to be connected together by inserting said rod through a selected pair of holes in said plate and a selected one of said bores, whereby said arm rest may be swung to the right or left.

7. The stack chair according to claim 4, wherein said arm rest is provided with a cover having a peripheral depending skirt extending below said hinge mechanism and a removable closure plate secured to the lower edges of said skirt.

8. The stack chair according to claim 7 wherein said cover is padded.

* * * * *